US005632657A

United States Patent [19]

Henderson

[11] Patent Number: 5,632,657

[45] Date of Patent: May 27, 1997

[54] MULTI-POSITION ADJUSTABLE TROLLING MOTOR TILLER HANDLE

[75] Inventor: William A. Henderson, Starkville, Miss.

[73] Assignee: Brunswick Corporation, Lake Forest, Ill.

[21] Appl. No.: 427,292

[22] Filed: Apr. 2, 1995

[51] Int. Cl.[6] ..... B63H 21/17

[52] U.S. Cl. ..... 440/6; 440/63

[58] Field of Search ..... 114/162, 144 R, 114/146; 440/6, 53, 63; 74/525, 530

[56] References Cited

U.S. PATENT DOCUMENTS

| | | | |
|---|---|---|---|
| 1,545,462 | 7/1925 | Watson et al. | 74/525 |
| 2,079,871 | 5/1937 | Price | 440/6 |
| 3,464,288 | 9/1969 | Sheridan | 74/525 |
| 3,861,348 | 1/1975 | Beierle | 440/6 |
| 3,955,438 | 5/1976 | Zakrzewski | 114/144 R |
| 4,656,960 | 4/1987 | Davenport | 114/146 |
| 4,916,969 | 4/1990 | Henning | 114/144 R |

*Primary Examiner*—Sherman Basinger
*Attorney, Agent, or Firm*—Rosenblatt & Redano

[57] ABSTRACT

A movable handle mounted to a trolling motorhead is disclosed. The handle is pivotally adjustable upwardly and downwardly to suit different positions of a fisherman while controlling the trolling motor. The handle spans across the motorhead and acts as a tiller for pivoting the motor about its axis. The resistance to positional changes is adjustable and protective features are provided to prevent damage to the adjustment mechanism in the event of tightening. The handle incorporates therein various controls for the motorhead.

14 Claims, 4 Drawing Sheets

MULTI-POSITION ADJUSTABLE TROLLING MOTOR TILLER HANDLE

FIELD OF THE INVENTION

The field of this invention relates to use and control of trolling motors for fishing from a boat.

BACKGROUND OF THE INVENTION

Motorboats of all styles have been used in the past for recreation as well as for support of fishing outings on various lakes, rivers, or other bodies of water. Such boats include a main outboard or inboard motor to rapidly place the boat in a desired location for fishing. Such boats also include significantly smaller trolling motors which are mounted to the boat for selective placement in the water for more precise positioning of the boat or repositioning of the boat once the general area where fishing is to take place has been rapidly reached using the main motor.

Generally speaking, the trolling motors have been placed on swinging linkages that stow the trolling motor on the gunwale of the boat for transport over the road or while motoring with the main inboard or outboard motor. The linkage can then be swung to position the propeller of the trolling motor in the water. Many prior designs using the swinging linkage would position the trolling motorhead, which contained the drive motor, in a fixed position from a vertical standpoint. The heads of such trolling motors had extension segments suitable for a grip of the hand to rotate the trolling motor about a vertical axis to effect directional changes in the boat while trolling. Still other swinging linkage support systems for the trolling motors also had various clamps and brackets which could be loosened and tightened selectively to physically adjust the height of the trolling motorhead and, hence, the propeller with respect to the waterline. These adjustments were usually made at one time at the outset by the fisherman and generally left undisturbed for subsequent fishing trips.

The shortcomings of the prior support mechanisms for trolling motors were that they were not readily flexible to different styles of fishing during trolling operation. Some fishermen prefer to sit; others prefer to stand; yet others go back and forth between those positions while trolling. A trolling motor in a relatively fixed position may accommodate a fisherman of a particular height or size in a particular position, but was not flexible to provide a greater degree of access and comfort to the trolling motor controls when the fisherman would move around while trolling.

The apparatus of the present invention has been developed to provide an easy way to obtain the desired flexibility to accommodate a wide variety of positions of the fisherman during trolling. Additionally, the handle is adjustable up or down, and the resistance to movement is also adjustable. Protective features in the mechanism have been employed to act positively to reduce, if not eliminate, potential damage to the apparatus due to overtightening. As a result, the disclosed apparatus gives the fisherman a firm grip on the trolling motorhead, adequate leverage to affect changes in course for the boat using the trolling motor, as well as an expanded range of adjustment to enhance the comfort of operation during trolling.

SUMMARY OF THE INVENTION

A movable handle mounted to a trolling motorhead is disclosed. The handle is pivotally adjustable upwardly and downwardly to suit different positions of a fisherman while controlling the trolling motor. The handle spans across the motor-head and acts as a tiller for pivoting the motor about its axis. The resistance to positional changes is adjustable and protective features are provided to prevent damage to the adjustment mechanism in the event of overtightening. The handle incorporates therein various controls for the motorhead.

DETAILED DESCRIPTION OF THE PREFERRED EMBODIMENT

Figure 2:
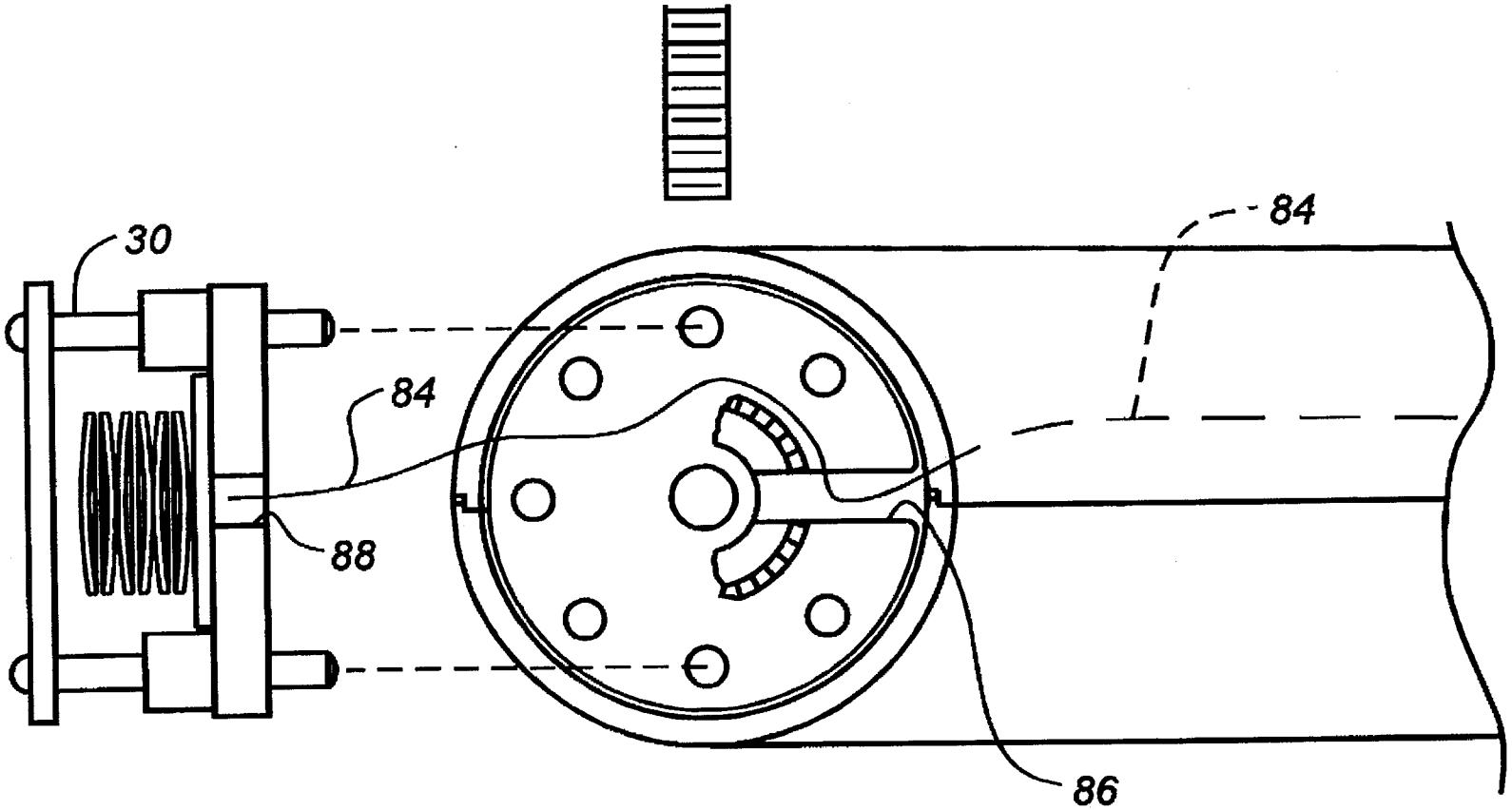
FIG. 2 is an elevational part-exploded view of the connection between the handle and the motorhead.
Figure 3:
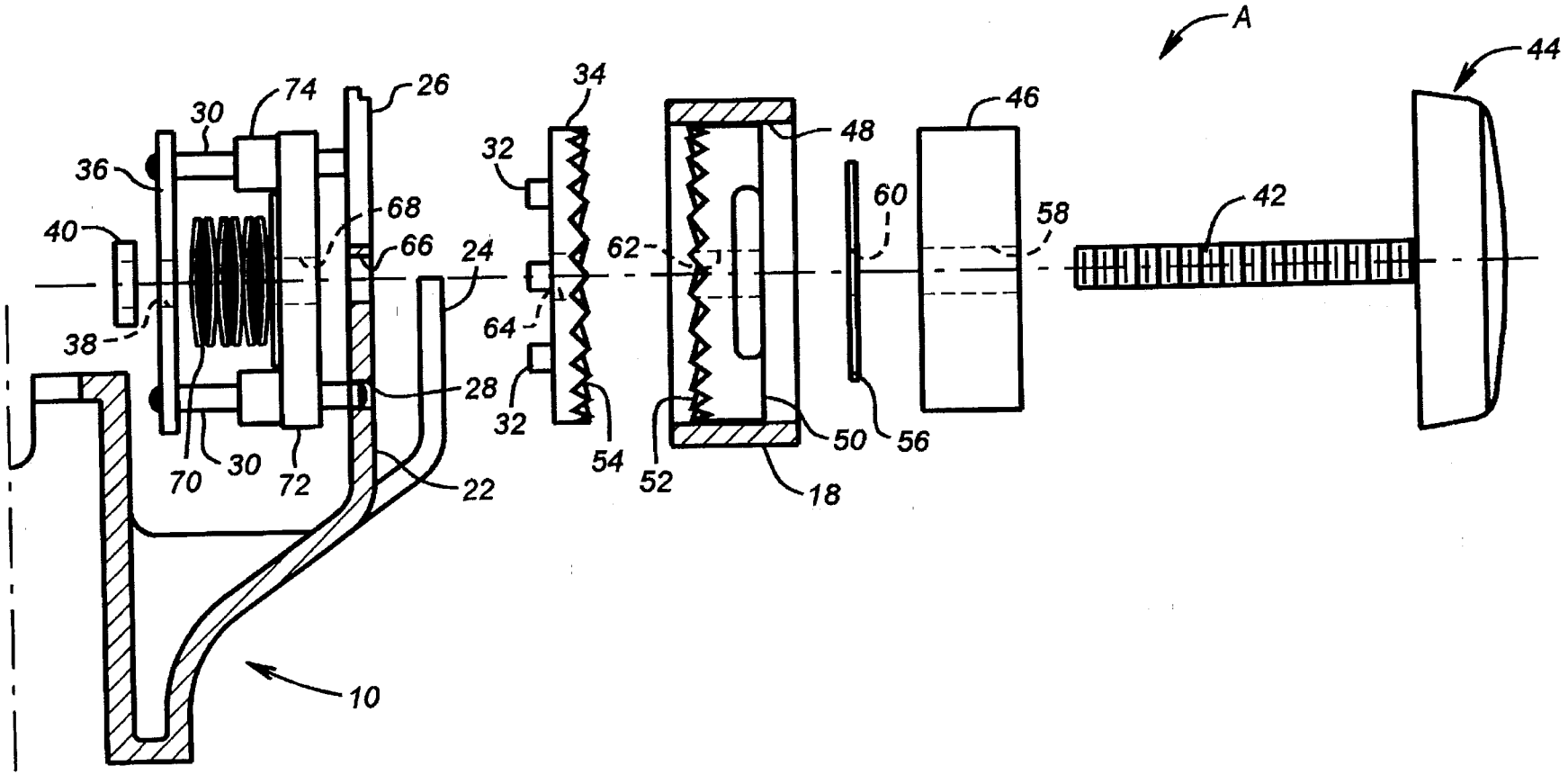
FIG. 3 is an elevational exploded view of the connections between the handle and motorhead.
Figure 4:
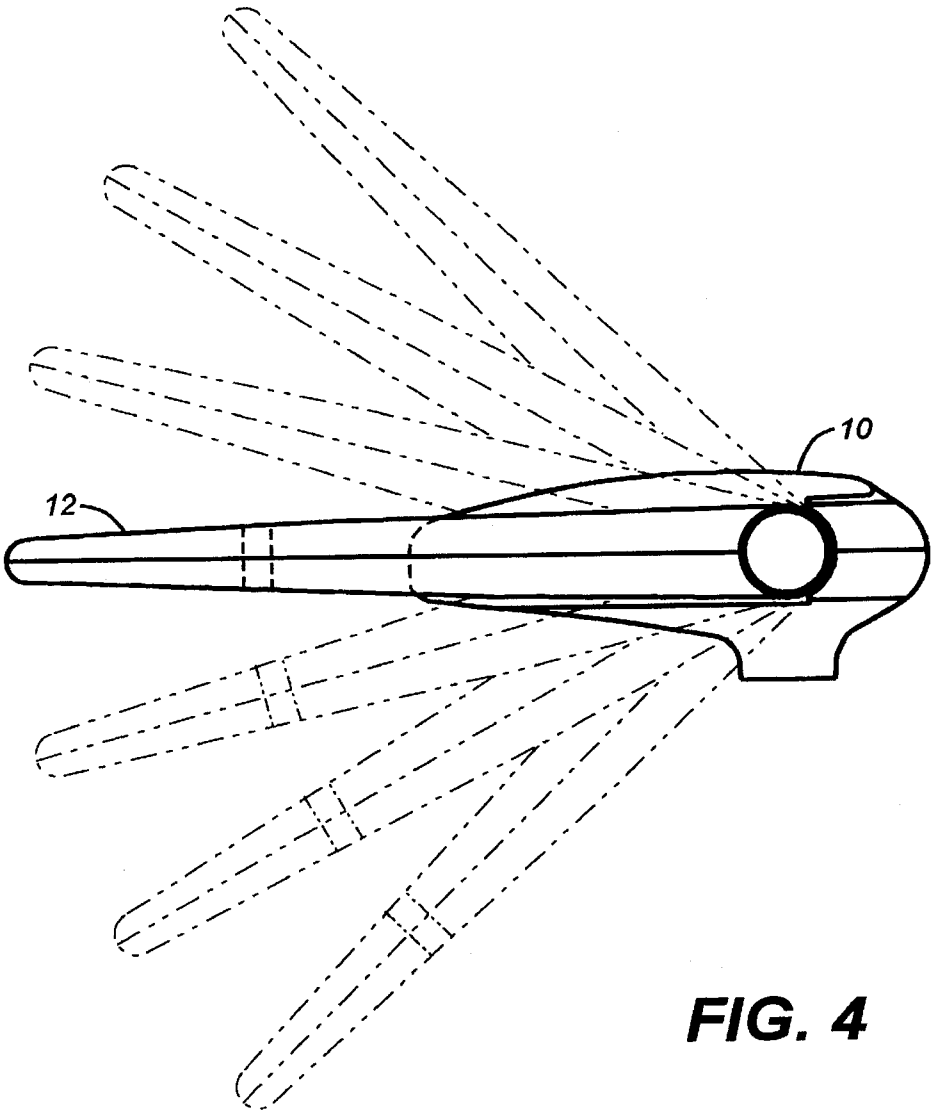
FIG. 4 shows the various positions of the handle with respect to the motorhead in dashed lines.

The overall shape of the motorhead 10 is shown in FIG. 4. A handle 12 is movable in the preferred range of ±45° from the horizontal position where the handle is illustrated in dark lines. Other degrees of movement can be incorporated into the design without departing from the spirit of the invention. The handle 12 straddles the motorhead 10 which is shown in a cutaway plan view in FIG. 1. The handle is attached at two pivot points 14 and 16, the details of which are shown in part in FIGS. 1 and 2, and in more detail in FIG. 3. While two pivot points 14 and 16 are preferred, one or more than two pivot points are also within the scope of the invention.

Figure 1:
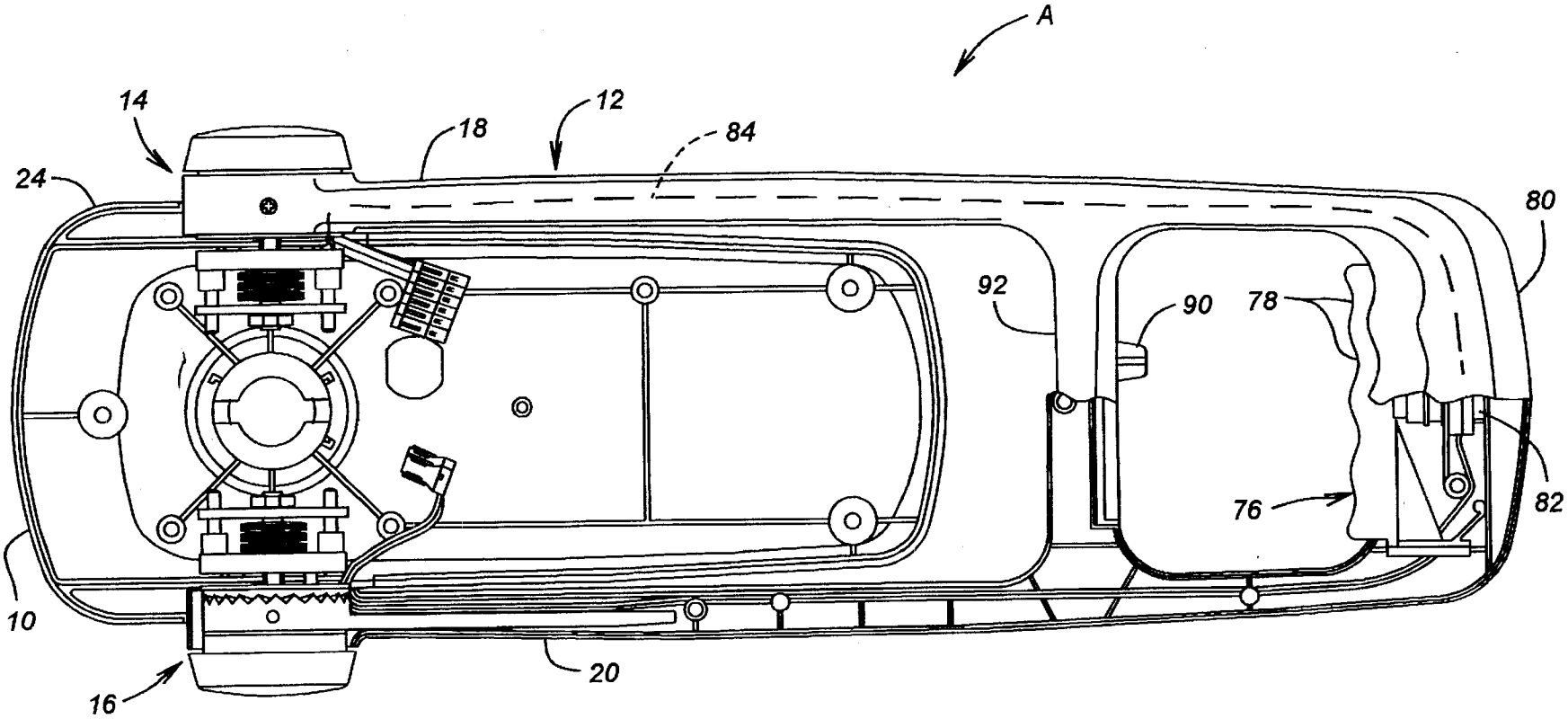
FIG. 1 is a plan view of the motorhead and assembled handle, showing the handle in a horizontal position.

The typical connection of the two shown, such as of segment 18 at pivot point 14 (see FIG. 1), is further illustrated in the exploded view of FIG. 3, which shows the clutch mechanism and adjustment system. The body of the motorhead 10 is shown in section. It has an outer wall 22. Further toward the front of the motorhead is a trim wall 24, which is also illustrated in FIG. 1. Outer wall 22 has an extending tab 26. Outer wall 22 has a series of openings 28 through which extend support rods 30. When fully assembled, the rods 30 go through the tab 26, through openings 28, and into serrated washer 34 at receptacles 32. Serrated washer 34 is thus retained against rotation. At the other ends of rods 30, a backplate 36 is attached. Plate 36 has a threaded bore 38 therethrough, and a threaded stop nut 40 is securely fastened to plate 36, with the threads of the nut 40 aligned with bore 38. The threaded shaft 42 on adjuster knob 44 ultimately extends through the assembly shown in FIG. 3 and threadedly engages the internal thread of nut 40.

Threaded shaft 42 extends through a flexible washer 46, preferably made of rubber of Durometer 50–60 on the Shore A scale. The rubber washer 46 can be of a desired thickness to accommodate the thickness of the handle segment, such as 18, which is shown in section in FIG. 3. Handle segment 18 ends in a bore 48, which holds therein a serrated washer 50. Serrated washer 50 rotates with handle 12. Serrated washer 50 has its serrations 52 facing serrations 54 of serrated washer 34. Between serrated washer 50 and rubber washer 46 is a thin clutch washer 56. Clutch washer 56 is preferably a thin metallic washer that backs up the thicker rubber washer 46 and promotes relative rotation between serrated washer 50 and rubber washer 46. Rubber washer 46 is inserted within bore 48 such that when the threaded shaft 42 is assembled through threaded bore 38 in plate 36, the assembly is held together. In order to secure the threaded shaft 42 to the threaded hole 38 on plate 36, the threaded shaft 42 must be advanced through bores 58, 60, 62, 64, 66, 68, and through the Belleville washers 70 and into threaded bore 38. The nut 40 is secured in a fixed relation to threaded shaft 42 and acts as a travel stop when the knob 44 is turned counterclockwise. When turning the knob 44 counterclockwise, the nut 40 advances to plate 36, at which point all further motion of knob 44 is impeded.

When knob 44 is rotated in a clockwise direction, it draws plate 36, which is connected through rods 30 to serrated washer 34 toward serrated washer 50, which is supported within bore 48 of the handle segment 18. The more that knob 44 is turned clockwise, the closer the contact between the serrations 52 and 54. To provide flexibility to allow the serrations 52 and 54 to skip over each other to make the adjustment of positions shown in FIG. 4, the Belleville washers 70 begin to get compressed as plate 36 advances toward them, forcing them against spacer 72. Spacer 72 has an integral extending sleeve 74 through which rods 30 extend. The limit of travel is reached when rotation in a clockwise direction of knob 44 advances plate 36 to the point where it bottoms on sleeve 74. It is desirable that even if such a bottoming situation occurs that the stack of washers 70 has not been completely flattened. In the preferred embodiment, six Belleville washers are stacked in three groups of two. In each group of two, the washers are arranged in series, i.e., in mirror image rather than aligned as soldiers. Accordingly, as the knob 44 is turned clockwise, the resistance exhibited by the apparatus A to changes in position of handle 12 is gradually increased to the point where it takes more force to move the handle 12 between or among the positions shown in FIG. 4, which are preferably at 10°–15° intervals. This occurs because serrations 52 and 54 are pressed together between washers 70 and rubber washer 46.

The addition of the rubber washer 46 is also helpful to avoid breakage of the apparatus A in the event that knob 44 is tightened clockwise very firmly. The apparatus A is designed in such a way that even if the resiliency of the stack of Belleville washers 70 is completely removed by flattening all of them, there is still enough play longitudinally as between the serrated washers 50 and 34 so that handle position changes can still be accomplished without locking the two facing serrations 52 and 54. Locking the serrations 52 and 54 together with sufficient longitudinal force can result in breaking off the teeth at the serrations 52 and 54 by a force applied to the handle 12 or, alternatively, can also result in a shear fracture of segments 18 or 20. To avoid this possibility, the rubber washer 46 is selected from a relatively soft rubber. This gives feedback to the fisherman that the knob 44 has been sufficiently tightened to avoid overtightening and, even under vigorous tightening, still leaves sufficient longitudinal play in the assembled components to allow sufficient longitudinal separation of the serrations 52 and 54 to accomplish a change in position without damaging the parts which could be made of a plastic or equivalent material.

Another feature of the apparatus A of the present invention is also illustrated in FIG. 1. An on/off actuator 76 has preformed finger slots 78 to accept the fisherman's hand which goes around end 80 of the handle 12. In the preferred embodiment, the handle 12 is a tall structure which accommodates therein the electrical switch assembly 82 to selectively operate the trolling motor through the motorhead 10. The wiring extends from switch assembly 82 through the handle segments 18 or 20. For example, a wire or wires 84 are shown in dashed lines as extending through segment 18 and through a notch 86 in stationary serrated washer 34. Aligned with the notch 86 is a hole in wall 22 allowing the wire to pass therethrough. The wire 84 continues through a notch 88 in the spacer 72, which is aligned with notch 86 on the opposite side of wall 22. Ultimately, the wire or wires 84 emerge within the motorhead 10, as shown in FIG. 1. When muted in this manner, the wiring 84 goes from handle 12 to motorhead 10 unaffected by turning motions of the handle 12 or the ratcheting action between serrations 52 and 54.

Those skilled in the art will appreciate that while the attachment at pivot point 14 has been described, the attachment at pivot point 16 is merely the mirror image and in all ways is preferably functional in the same manner.

Other features can be incorporated into the handle 10 from a control standpoint such as an intermittent operation switch 90, which can be used for selective periodic actuation of the trolling motor through the motorhead 10, at intervals of varying length.

Although the force adjustment has been described as being accomplished with a stack of Belleville washers 70, other types of flexible mechanisms can be employed without departing from the spirit of the invention. Even when using Belleville washers 70, they can be arranged in many different ways, such as some in series and some in parallel, to give a graduated increase in force if uniformly stacked or a step increase in force if stacked in such combinations as series and parallel.

The switch 90 can be installed on a cross-brace 92 to give greater structural integrity to the handle 12. The adjustment knobs 44 at pivot points 14 and 16 can be independently operated and need not necessarily be set at the same level of resistance to movement, thereby giving the fisherman additional flexibility in designing the optimal resistance to a change in position of handle 12. Furthermore, by providing the apparatus A, the fisherman can adjust the knobs 44 for less resistance during periods where he or she will be changing positions more frequently. Having later achieved a position of most comfort, the knobs 44 can be adjusted to secure the handle 12 more firmly in the positions illustrated in FIG. 4. In the preferred embodiment, the ratchet intervals dictated by the profile of the serrations 52 and 54 permit easy fixation of the handle 12 at 10°–15° increments. However, other intervals can be employed without departing from the spirit of the invention.

With the shape and structure of the handle 12 as shown in FIG. 1, easy and precise course corrections can be achieved with greater comfort due to the leverage provided by the manner in which the handle 12 is attached to the motorhead 10 and its internal rigidity displayed in its design.

The foregoing disclosure and description of the invention are illustrative and explanatory thereof, and various changes in the size, shape and materials, as well as in the details of the illustrated construction, may be made without departing from the spirit of the invention.

I claim:

1. In combination, an apparatus for controlling a trolling motor, comprising:

a trolling motor assembly further comprising a motorhead, said assembly mountable to a boat in a manner to allow rotation of said motorhead in at least a first plane to effect course changes for the boat;

an adjustable handle extending into said motorhead in at least one location to facilitate said movement of said motorhead in said first plane;

a clutch mechanism mounted between said handle and said motorhead and extending at least in part into said motorhead to facilitate selective placement of the handle in a plurality of positions as desired for control of said motorhead;

said clutch mechanism further comprises an adjustment system to regulate the amount of force required to reposition said handle pivotally with respect to said motorhead;

said handle is adjustable in a second plane different from said first plane;

said second plane is substantially transverse to said first plane;

said handle is pivotally mounted to said motorhead;

said handle is adjustable to include a position in substantial alignment with said motorhead as well as a positive or negative angular misalignment;

said adjustment system comprises a pair of mating elements comprising a first and second member defining a plurality of closely spaced ratchet positions therebetween, one of said pair supported by said motorhead and the other by said handle;

a biased resilient urging mechanism accessible externally to said handle when assembled to said motorhead to selectively regulate the spacing between said mating elements.

2. The apparatus of claim 1, wherein said resilient urging mechanism further comprises:

an adjustment knob operably connected to one of said mating elements through a biasing member which is selectively compressed by actuation of said knob urging said one of said pair toward the other of said pair;

a backing member supported by said knob, said other of said pair urged toward said backing member when said biasing member urges said one of said pair toward said other, whereupon the required force to pivot said handle can be varied based on the opposing forces on said mating elements exerted by said biasing member and said backing member.

3. The apparatus of claim 2, wherein:

said biasing member comprises a plurality of Belleville washers;

said backing member comprises a resilient washer with a hardness about 50–60 Durometer on the Shore A scale.

4. The apparatus of claim 2, further comprising:

a travel stop to limit the force applied to said biasing member at a point where said backing member provides sufficient flexibility to allow said mating elements to rotate with respect to each other without damage to said ratchet positions.

5. The apparatus of claim 2, wherein:

said ratchet positions correspond to intervals of about 10°–15° over a range of pivotal movement of said handle of about 90°.

6. The apparatus of claim 1, wherein:

said first member of said mating elements supported by said motorhead is fixed thereto against rotation while said second member ratchets over it with pivoting of said handle.

7. The apparatus of claim 6, wherein:

said first member has an opening therethrough;

said handle further comprises electrical controls mounted thereto with wiring extending therefrom through said opening in said fixed member and into said motorhead without becoming engaged between said mating elements as one rotates with respect to the other.

8. In combination, an apparatus for controlling a trolling motor, comprising:

a trolling motor assembly further comprising a motorhead, said assembly mountable to a boat in a manner to allow rotation of said motorhead in at least a first plane to effect course changes for the boat;

an adjustable-handle extending into said motorhead in at least one location to facilitate said movement of said motorhead in said first plane;

a clutch mechanism mounted between said handle and said motorhead and extending at least in part into said motorhead to facilitate selective placement of the handle in a plurality of positions as desired for control of said motorhead;

said clutch mechanism further comprises an adjustment system to regulate the amount of force required to reposition said handle pivotally with respect to said motorhead;

said adjustment system comprises a pair of mating elements comprising a first and second member defining a plurality of closely spaced ratchet positions therebetween, one of said pair supported by said motorhead and the other by said handle;

a biased resilient urging mechanism accessible externally to said handle when assembled to said motorhead to selectively regulate the spacing between said mating elements.

9. The apparatus of claim 8, wherein said resilient urging mechanism further comprises:

an adjustment knob operably connected to one of said mating elements through a biasing member which is selectively compressed by actuation of said knob urging said one of said pair toward the other of said pair;

a backing member supported by said knob, said other of said pair urged toward said backing member when said biasing member urges said one of said pair toward said other, whereupon the required force to pivot said handle can be varied based on the opposing forces on said mating elements exerted by said biasing member and said backing member.

10. The apparatus of claim 8, wherein:

said ratchet positions correspond to intervals of about 10–15° over a range of pivotal movement of said handle of about 90°.

11. The apparatus of claim 8, wherein:

said first member of said mating elements supported by said motorhead is fixed thereto against rotation while said second member ratchets over it with pivoting of said handle.

12. The apparatus of claim 11, wherein:

said first mating member has an opening therethrough;

said handle further comprises electrical controls mounted thereto with wiring extending therefrom through said opening in said fixed member and into said motorhead without becoming engaged between said mating elements as one rotates with respect to the other.

13. In combination, an apparatus for controlling a trolling motor, comprising:

a trolling motor assembly further comprising a motorhead, said assembly mountable to a boat in a manner to allow rotation of said motorhead in at least a first plane to effect course changes for the boat;

an adjustable handle mounted to said motorhead in at least one location to facilitate said movement of said motorhead in said first plane;

a clutch mechanism mounted between said handle and said motorhead to facilitate selective placement of the handle in a plurality of positions as desired for control of said motorhead;

said clutch mechanism further comprises an adjustment system to regulate the amount of force required to reposition said handle pivotally with respect to said motorhead;

said adjustment system comprises a pair of matins elements defining a plurality of closely spaced ratchet positions therebetween, one of said pair supported by said motorhead and the other by said handle;

a resilient urging mechanism to selectively regulate the spacing between said mating elements;

said urging mechanism comprising a plurality of Belleville washers and a resilient washer with a hardness about 50–60 Durometer on the Shore A scale.

14. In combination, an apparatus for controlling a trolling motor, comprising:

a trolling motor assembly further comprising a motorhead, said assembly mountable to a boat in a manner to allow rotation of said motorhead in at least a first plane to effect course changes for the boat;

an adjustable handle mounted to said motorhead in at least one location to facilitate said movement of said motorhead in said first plane;

a clutch mechanism mounted between said handle and said motorhead to facilitate selective placement of the handle in a plurality of positions as desired for control of said motorhead;

said clutch mechanism further comprises an adjustment system to regulate the amount of force required to reposition said handle pivotally with respect to said motorhead;

said adjustment system comprises a pair of mating elements defining a plurality of closely spaced ratchet positions therebetween, one of said pair supported by said motorhead and the other by said handle;

a resilient urging mechanism to selectively regulate the spacing between said mating elements; and a travel stop to limit the force applied to said urging mechanism at a point where said urging mechanism provides sufficient flexibility to allow said mating elements to rotate with respect to each other without damage to said ratchet positions.

* * * * *